US007150581B2

(12) United States Patent
Lowe

(10) Patent No.: US 7,150,581 B2
(45) Date of Patent: Dec. 19, 2006

(54) LANE MARKER MASKING SYSTEM

(76) Inventor: Clifford A. Lowe, 3632 Litchfield Dr., Rocky Mount, NC (US) 27803

( * ) Notice: Subject to any disclaimer, the term of this patent is extended or adjusted under 35 U.S.C. 154(b) by 77 days.

(21) Appl. No.: 10/535,471

(22) PCT Filed: Nov. 18, 2003

(86) PCT No.: PCT/US03/37125

§ 371 (c)(1),
(2), (4) Date: May 17, 2005

(87) PCT Pub. No.: WO2004/045905

PCT Pub. Date: Jun. 3, 2004

(65) Prior Publication Data

US 2006/0165485 A1 Jul. 27, 2006

(51) Int. Cl.
*E01C 23/16* (2006.01)
*E01C 23/18* (2006.01)

(52) U.S. Cl. ..... 404/75; 404/94

(58) Field of Classification Search ..... 404/75, 404/93, 94

See application file for complete search history.

(56) References Cited

U.S. PATENT DOCUMENTS 5,835,614 A * 11/1998 Aoyama et al. ..... 382/104

* cited by examiner

*Primary Examiner*—Raymond W Addie
(74) *Attorney, Agent, or Firm*—Zollinger & Burleson Ltd.

(57) ABSTRACT

A lane marker mask includes a visible surface configured to match the road surface where the mask will be used. The visible surface may be created by photographing the road surface immediately adjacent the eventual location of the mask and printing the photograph onto the visible surface of the masking material. An adhesive is disposed on the bottom of the masking material and a protective top coating is disposed over the printed image to protect the image during use. In another embodiment of the invention, a series of road surface images are provided in a printed or electronic catalog. The user selects the image to be used on the visible surface of the mask by comparing the target road surface to the images presented in the catalog. Masks made in accordance with this invention are less distracting to motorists because they blend into the surrounding road surfaces.

17 Claims, 4 Drawing Sheets

LANE MARKER MASKING SYSTEM

BACKGROUND OF THE INVENTION

1. Technical Field

The present invention generally relates to masking systems and, more particularly, to a lane marker masking system used and method for manufacturing the mask. Specifically, the present invention relates to a lane marker mask having an appearance that simulates the road surface immediately adjacent the location 2. Background Information Road construction projects that divert traffic from an existing road use masks to hide the old lane markers from view while temporary lane markers are used to direct traffic onto the temporary path. In the past, the old lane markers were painted or removed from the existing road surface. In some situations, removal of the markers is undesirable because the markers are going to be used when the road is placed back in service. In these situations, masks have been used to hide the markers during the construction project. The masks are typically provided in a solid, uniform dark color without regard to the color of the road surface.

The color and texture of road surfaces greatly varies depending on the material of the road and the condition of the material. Even the same type of material can take on significantly different appearance after being exposed to different weather conditions over time. When the mask does not match the road appearance, the masks can act as undesirable visual distractions to a driver who is approaching the construction site. The art thus desires a lane marker mask that matches the road surface where the mask will be used.

BRIEF SUMMARY OF THE INVENTION

One embodiment of the invention provides a mask for a lane marker that simulates the appearance of the road surface adjacent the lane marker. The invention provides a mask having an upper visible surface configured to simulate the road surface where the mask will be used. In one embodiment, the upper visible surface of the mask is a printed photograph of the road surface adjacent the lane marker to be masked. The mask thus matches the color and texture of the road surface. Another embodiment of the invention provides a mask provided in a blend of colors that match the appearance of a road surface.

Another embodiment of the invention provides a method for making a mask for a lane marker. The method includes the steps of photographing the road surface adjacent the marker to be masked and printing the photograph onto a masking material. The printed photograph is then used to mask the lane markers so that the mask matches the road surface.

The invention further provides a lane marker masking system that includes a plurality of road surface patterns that are available on a web site or a printed catalog. The user who needs the masks may choose the closest pattern to the road surface to be masked and order the masks directly from the supplier. The user may also print the available patterns from the web site and take them to the road surface where the masks will be used in order to determine the best match. The user may also photograph the road surface and compare the photograph with the catalog of patterns or with the patterns available online. The user may also send the photograph to the supplier and allow the supplier to match the pattern.

BRIEF DESCRIPTION OF THE SEVERAL VIEWS OF THE DRAWINGS

Similar numbers refer to similar parts through the specification.

DETAILED DESCRIPTION OF THE INVENTION

Figure 1:
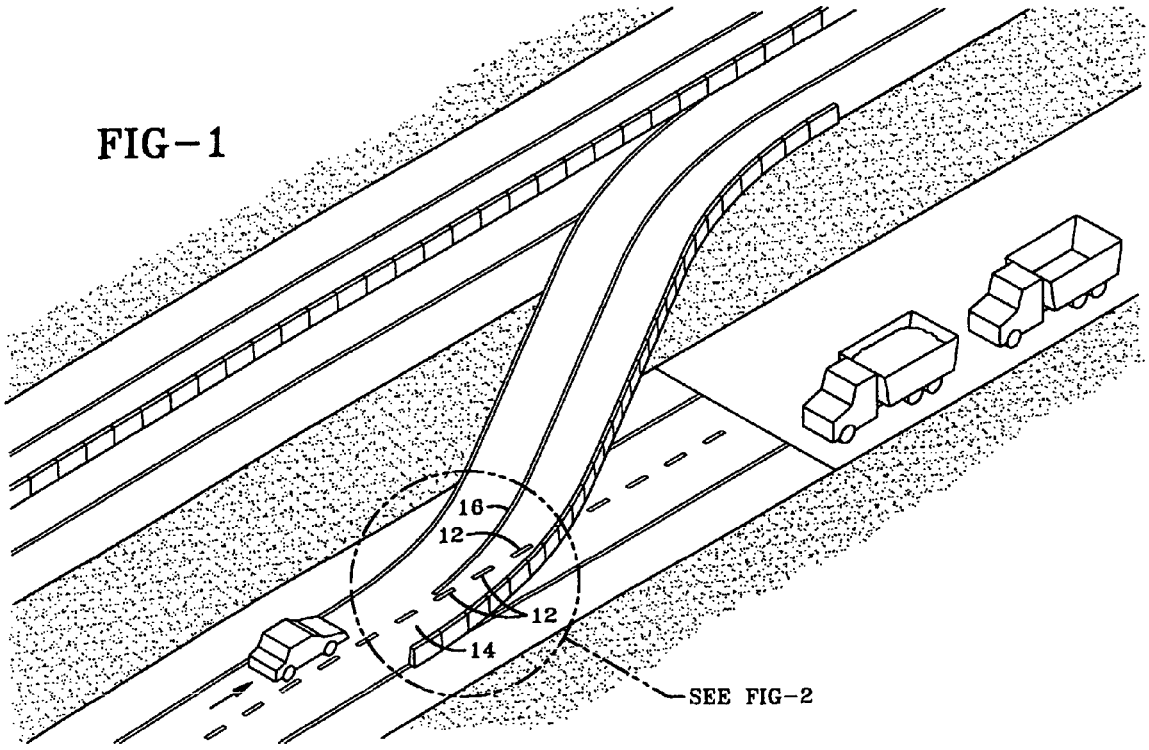
FIG. 1 is a perspective view of a portion of a road construction project where lane markings must be masked.
Figure 2:
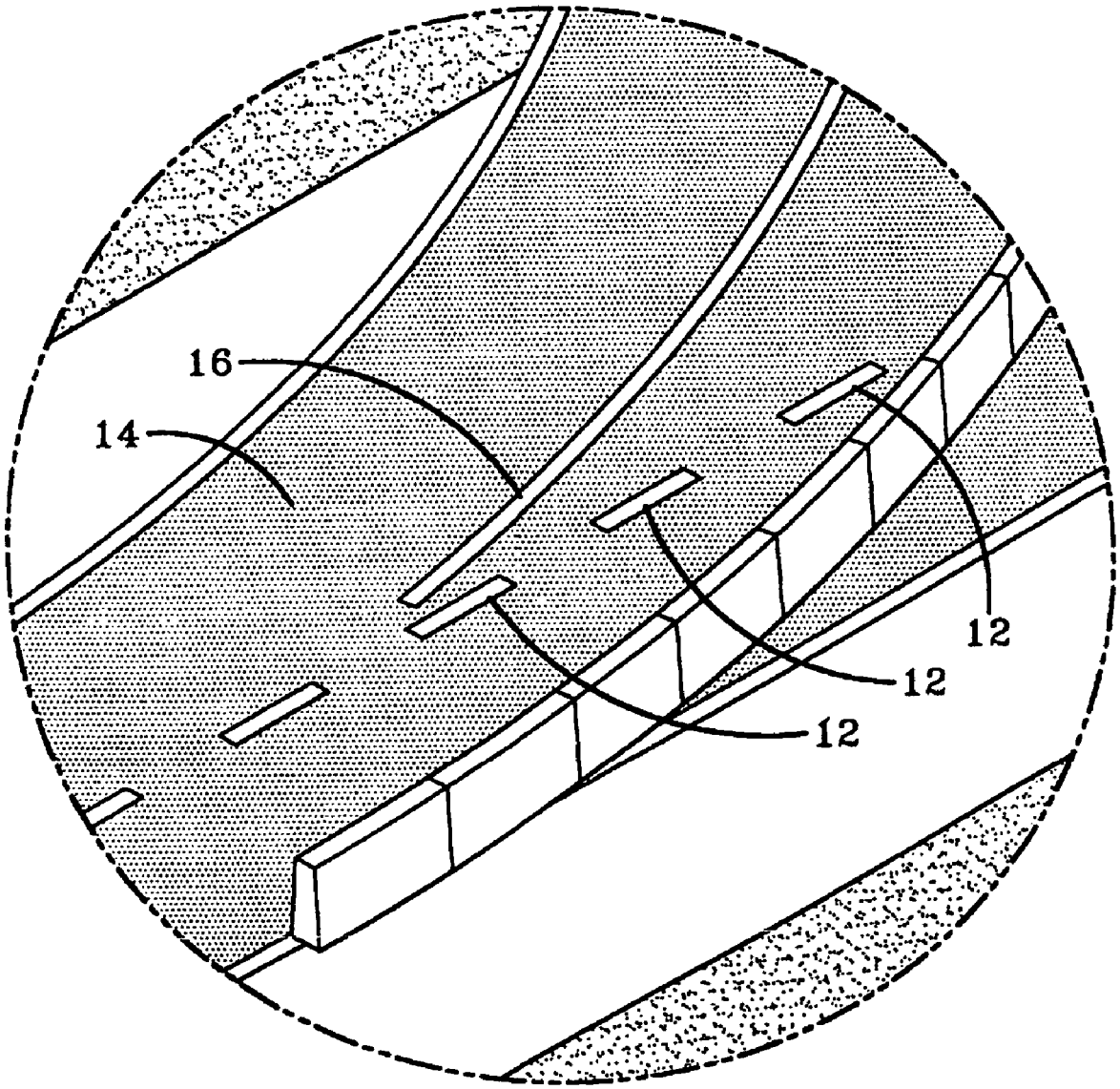
FIG. 2 is an enlarged view of the encircled portion of FIG. 1.
Figure 3:
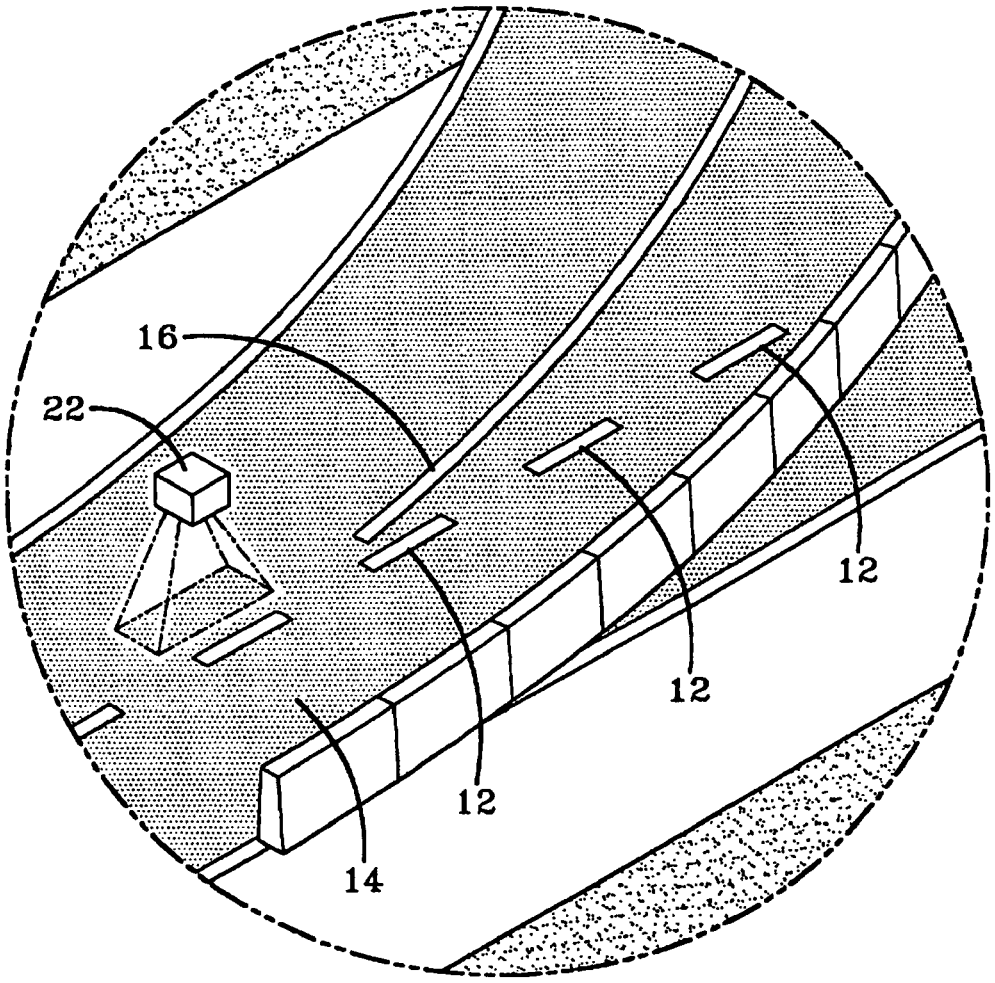
FIG. 3 is a view similar to FIG. 2 showing a portion of the road surface being photographed.
Figure 4:
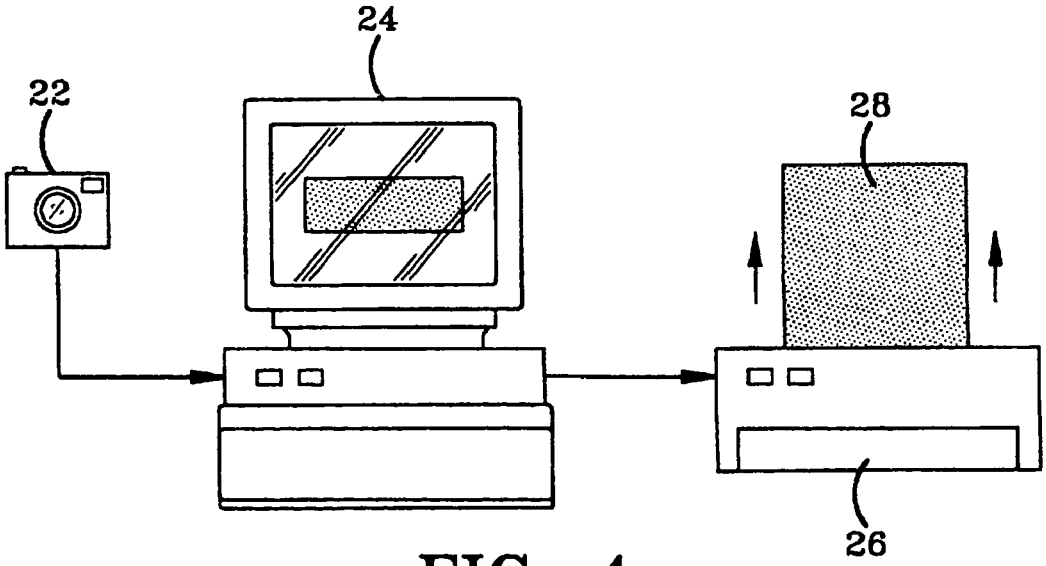
FIG. 4 is a schematic view of a camera, a computer system, and a printing system used to make the mask of the invention.
Figure 5:
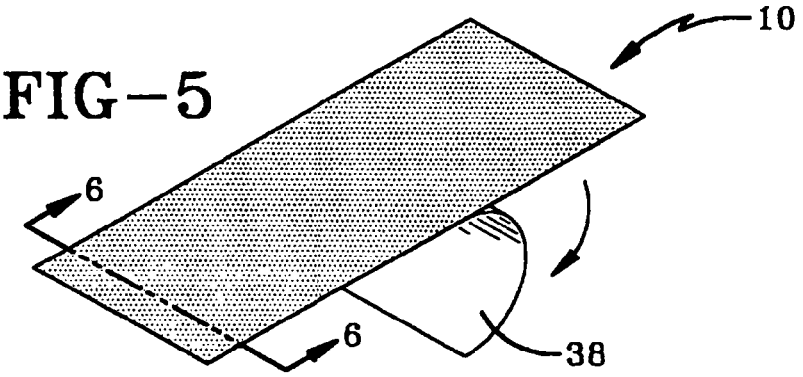
FIG. 5 is a perspective view of a mask made in accordance with the concepts of the present invention.
Figure 6:
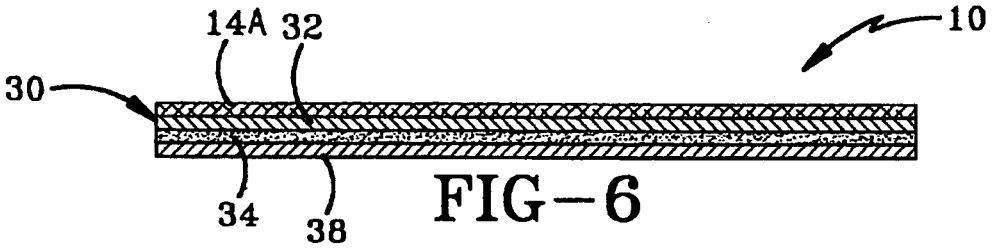
FIG. 6 is a section view taken along line 6—6 of FIG. 5.
Figure 7:
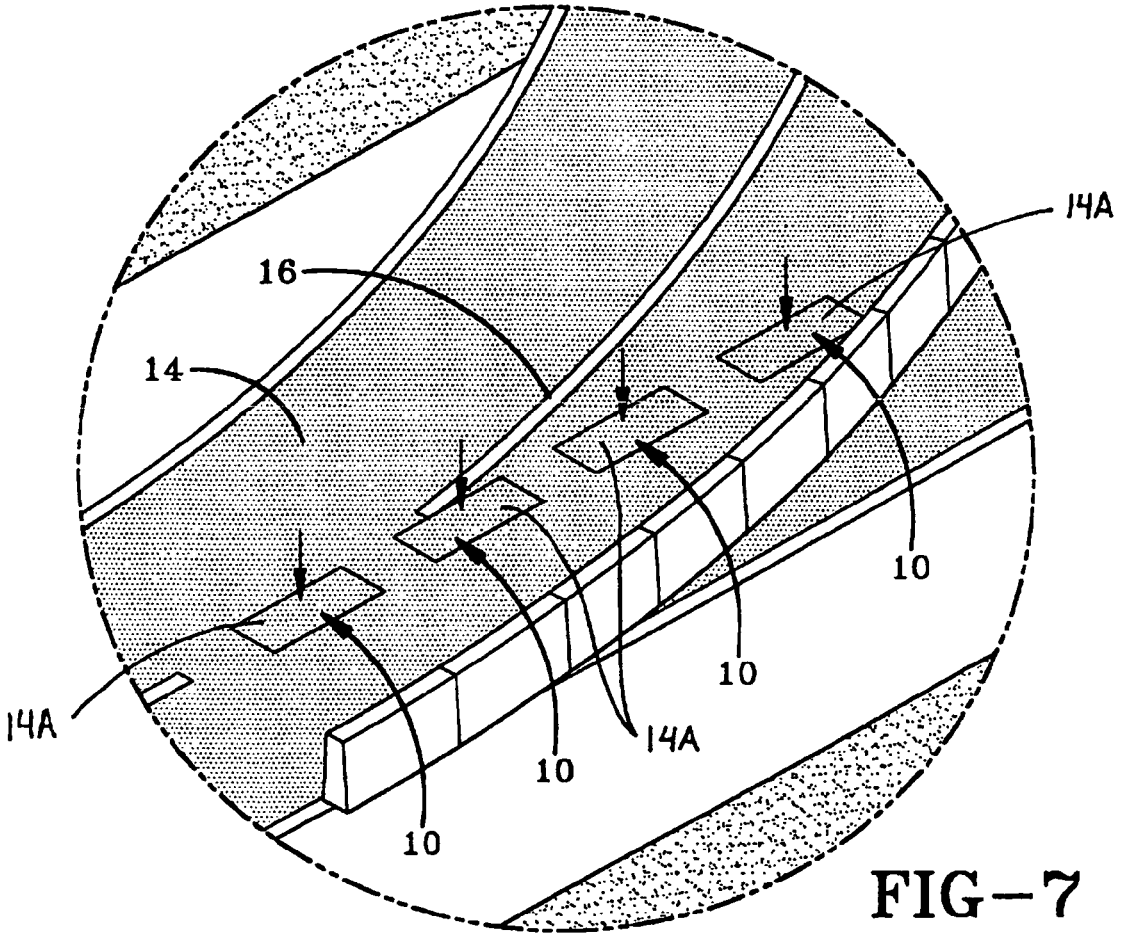
FIG. 7 is a view similar to FIG. 2 showing masks being applied over the lane markers.

The mask of the present invention is indicated generally by the numeral 10 in the accompanying drawings. Mask 10 is used to hide old lane markers 12 on a road surface 14 so that a driver approaching a construction site will not be visually distracted by masks 10. Mask 10 allows the driver to focus on the new lane markers 16 and safely pilot his vehicle through the construction site.

Mask 10 is fabricated by photographing road surface 14 with a camera 22. Camera 22 captures an image of road surface 14 adjacent markers 12 to be masked. In another embodiment of the invention, a book of road surfaces may be created by photographing a variety of road surfaces. In this case, the user would compare the book of road surfaces to road surface 14 adjacent markers 12 to find a close match. In another embodiment of the invention, the catalog of available mask patterns is published at a web site that is available to potential users of the masks. The user may then select the pattern by printing some available patterns and comparing them to the road surface. The user may alternatively photograph the road surface and compare the photograph to the available patterns.

Camera 22 may capture the image on film or in a digital format. When a digital camera is used, the image captured by camera 22 is processed by a computer 24. The image is then printed by a printer 26 that is adapted to print color images onto a masking material 28 to create mask 10. Printer 26 may use a screen printing technique, an electrostatic printing technique, an electrophotographic printing technique, an offset printing technique, a thermal ink jet printing technique, or a thermal mass transfer printing technique. Other printing methods may be continuous rotary screen printing or continuous flat bed printing.

One exemplary printer is a Zund brand UV Jet 215-C Printer having the following specifications: Four color piezo inkjet CMYK; Print speed: 75 to 140 square feet per hour; print resolution: 360 dpi; maximum print width: 84 inches; maximum print thickness: 1.5 inches; continuous roll feed: vacuum fixation; continuous supply with individual low level warning; and on-line replenishing. Other suitable printers include: Roland DGA Corporation's FJ-540/CJ-540/

SoijectSC-500; Mutoh's Toucan NxPro; Epson's Stylus Pro 10600 Scitex Vision's Scitex XL Jet; Graphitec's JX 2150 60"; NUR America's Nur Tempo; Vutek's Press Vu UV 80; Arizona's Arizona 500; and Sericol America's Inca Eagle 44.

Mask 10 is fabricated from a mask material 30 that is configured to be printed on by printer 26. Material 30 has a body 32 that may have an upper surface that is relatively smooth to allow the image 14A of road surface 14 to be printed onto the upper surface. Material 30 may also be embossed. An adhesive 34 may be provided on the lower surface of body 32 to allow mask 10 to be connected to road surface 14 over lane marker 12. Adhesive 34 may be a permanent or removable adhesive. In other embodiments of the invention, adhesive 34 is not connected to body 32 until the user is ready to install mask 10. In this embodiment, the user may place the adhesive onto road surface 14 and then place body 32 down onto the adhesive. When adhesive 34 is connected to the lower surface of body 32, a cover 38 may be provided to keep adhesive 34 clean until mask 10 is ready to be used. Adhesive 34 may be adapted to be applied in hot and cold weather. Adhesive 34 may also be configured to allow mask 10 to be rolled on itself or stacked with other masks 10. Adhesive 34 may be a permanent or removable adhesive. Removable adhesives allow mask 10 to be easily removed from the road and reused. A permanent adhesive allows mask 10 to remain in place for months or years and makes removal difficult.

If desired, adhesive 34 may be removed and mask 10 may be connected with other connectors such as mechanical fasteners like screws, nails, hook-and-loop and the like.

Material 30 is adapted to withstand outdoor road conditions and is resistant to water, salt, dirt, and oils. Material 30 may be fabricated from alpha-olefins such as polyethylene, polypropylene, and blends and copolymers thereof; ethylene-modified copolymers such as ethylene vinyl acetate, ethylene acrylic acid, ethylene methacrylic acid, ethylene methacrylate and blends and mixed polymers of these materials such as ethylene methylacrylate acrylic acid terpolymers, polyurethanes, poly(vinyl chloride) and rubbery polymers such as ethylene propylene diene monomer terpolymer, rubber modified polyolefins and styrene butadiene rubbers. A particularly preferred material for the base layer 16 is a butadiene-acrylonitrile-polyvinyl chloride polymer.

In one embodiment of the invention, material 30 is 100% polyester plain weave. The weight may fall in a range of 1.00 oz/sq. yard to 8.00 oz/sq. yard, preferably 3.25 oz/sq. yard. The material is finished with: Adhesion Promoter to Rubber (RFL Dip) OR Adhesion promoter to Rubber RFL Dip one side and white acrylic coating on other side.

Other possible substrates include: PVC/Nitrile blend; Carboxylated nitrile; EPDM Blend; Embossed (any material listed above) base sheet raised to form a pattern; Foil; and Reinforced (any material listed that has been reinforced; for example, fabric and scrim or PVC/Nitrile and scrim).

Material 30 may be top coated if desired. Suitable top coats are Rust-Oleum 9700 system (two-component acrylic polyurethane), Pegatane Hydro, and adhesives and adhesive laminates. Material 30 may include any of a variety of anti-skid particles known in the art. Examples include aluminum oxide, pumice, silica, quartz silica, crushed glass, etc. The top coating should be water-, oil-, and soil-resistant. One suitable material is a flurocarbon resin with polymeric, hyperbranched dendrimers in a hydrocarbon matrix, cationic (available from Rudolf Chemical, Rucostar EEE, Ruco-Couard AFR).

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A mask for a lane marker on a road surface that has a visual appearance; the mask comprising:

a section of masking material having an upper surface and a lower surface; and a visible image disposed on the upper surface of the section of masking material; the visible image adapted to simulate the visual appearance of the road surface where the lane marker is disposed.

2. The mask of claim 1, wherein the visible image is printed on the upper surface of the section of masking material.

3. The mask of claim 2, wherein the visible image is printed from a photograph of the road surface disposed adjacent the location of the lane marker to be masked.

4. The mask of claim 3, wherein the photograph is a digital photograph.

5. The mask of claim 1, further comprising an adhesive disposed on the lower surface of the section of masking material.

6. The mask of claim 5, further comprising a layer of top coating material disposed over the visible image on the section of masking material.

7. The mask of claim 6, further comprising anti-skid particles disposed in the layer of top coating.

8. The mask of claim 1, wherein the upper surface of the section of masking material is smooth.

9. The mask of claim 1, wherein the section of masking material is 100 percent polyester plain weave.

10. A method for creating a mask for a lane marker on a road surface wherein the road surface has a visual appearance; the method comprising the steps of:

(a) photographing the visual appearance of the road surface adjacent the location of the lane markers to be masked;

(b) printing at least a portion of the photograph on a section of masking material; and (c) using the masking material to mask a lane marker on the road surface.

11. The method of claim 10, further comprising the step of using a digital camera in step (a) and transmitting the digital photograph to the printer that is used to perform step (b).

12. The method of claim 10, wherein step (c) includes the step of applying a top coating to the section of masking material.

13. The method of claim 12, wherein step (c) includes the step of applying an adhesive to the lower surface of the section of masking material.

14. The method of claim 12, wherein step (c) further includes the step of applying anti-skid particles to the top coating.

15. A method for creating a lane marker mask; the method comprising the steps of:

(a) photographing a plurality of different road surfaces to create a plurality of road surface images;

(b) creating a plurality of lane marker masks with each of the lane marker masks having an upper surface with each of the upper surfaces having a visual image; the visible images adapted to simulate the road surface images created in step (a);

(c) publishing the plurality of images created in step (a); and (d) offering the plurality of lane marker masks for sale that were created in step (b).

16. The method of claim 15, wherein step (c) includes the step of publishing the images on a web site that is accessible through a wide area network.

17. The method of claim 15, wherein step (c) includes the step of publishing the images in a printed catalog.

* * * * *